US009868122B2

(12) United States Patent
Fornefeld et al.

(10) Patent No.: US 9,868,122 B2
(45) Date of Patent: Jan. 16, 2018

(54) ROLLER MILL AND METHOD FOR MILLING MATERIAL TO BE MILLED BY MEANS OF A ROLLER MILL

(71) Applicant: THYSSENKRUPP INDUSTRIAL SOLUTIONS AG, Essen (DE)

(72) Inventors: Heiko Fornefeld, Hamm (DE); Pedro Guerrero Palma, Lippetal (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 342 days.

(21) Appl. No.: 14/419,214

(22) PCT Filed: Jul. 31, 2013

(86) PCT No.: PCT/EP2013/066119
§ 371 (c)(1),
(2) Date: Feb. 2, 2015

(87) PCT Pub. No.: WO2014/020079
PCT Pub. Date: Feb. 6, 2014

(65) Prior Publication Data

US 2015/0196923 A1 Jul. 16, 2015

(30) Foreign Application Priority Data

Aug. 1, 2012 (DE) ..... 10 2012 107 043

(51) Int. Cl.
*B02C 25/00* (2006.01)
*B02C 15/00* (2006.01)

(52) U.S. Cl.
CPC ..... *B02C 25/00* (2013.01); *B02C 15/006* (2013.01); *B02C 15/007* (2013.01)

(58) Field of Classification Search
CPC ..... B02C 15/006; B02C 15/007; B02C 25/00
(Continued)

(56) References Cited

U.S. PATENT DOCUMENTS 8,262,006 B2 * 9/2012 Berger ..... B02C 15/006 241/119
9,199,240 B2 * 12/2015 Lessard ..... B02C 15/006
(Continued)

FOREIGN PATENT DOCUMENTS

CN 2753456 Y 1/2006
CN 101528353 A 9/2009
(Continued)

OTHER PUBLICATIONS

German Language International Search Report for International patent application No. PCT/EP2013/066119; dated Feb. 18, 2014.
(Continued)

*Primary Examiner* — Faye Francis
(74) *Attorney, Agent, or Firm* — thysenkrupp North America, Inc.

(57) ABSTRACT

The roller mill according to the invention is composed essentially of at least two grinding rollers which interact with a grinding plate for comminuting material to be ground, wherein the at least two grinding rollers or the grinding plate and at least one grinding roller are each assigned a separate drive train for driving same, wherein each drive train has a main motor and a main gear mechanism. At least one drive train additionally comprises a superimposition gear mechanism with a regulating drive, wherein an open-loop and closed-loop control device which is connected to the at least one regulating drive is provided, said open-loop and closed-loop control device regulating the power of the separate drive trains with respect to one another by means of the at least one regulating drive.

10 Claims, 8 Drawing Sheets

(58) Field of Classification Search
USPC ..... 241/36, 117–122
See application file for complete search history.

(56) References Cited

U.S. PATENT DOCUMENTS

| | | | | |
|---|---|---|---|---|
| 2009/0261190 | A1* | 10/2009 | Hoffmann | B02C 15/006 241/63 |
| 2010/0193616 | A1* | 8/2010 | Berger | B02C 15/006 241/30 |
| 2011/0121772 | A1* | 5/2011 | Berger | B02C 25/00 318/504 |

FOREIGN PATENT DOCUMENTS

| | | | |
|---|---|---|---|
| DE | 3507913 | A1 | 9/1986 |
| DE | 19702854 | A1 | 7/1998 |
| DE | 102006050205 | A1 | 5/2008 |
| DE | 102007033256 | A1 | 1/2009 |
| DE | 102008036784 | A1 | 2/2010 |
| DE | 202009016825 | U1 | 4/2010 |
| DE | 102009057732 | A1 | 6/2011 |
| EP | 2389248 | B1 | 11/2011 |
| WO | 2009/030609 | A1 | 3/2009 |

OTHER PUBLICATIONS

English Translation of International Search Report for International patent application No. PCT/EP2013/066119; dated Feb. 18, 2014.
English translation of abstract of DE 19702854 (A1).
English translation of abstract of DE 3507913 (A1).
English translation of abstract of DE 102007033256 (A1).
English translation of abstract of DE 102009057732 (A1).
English translation of abstract of DE 102008036784 (A1).
English translation of abstract of DE 202009016825 (U1).
English translation of abstract of DE 102006050205 (A1).
English Language Abstract for EP2389248B1.
English Language Abstract for CN2753456Y.
English Language Abstract for CN101528353A.

* cited by examiner

ROLLER MILL AND METHOD FOR MILLING MATERIAL TO BE MILLED BY MEANS OF A ROLLER MILL

CROSS REFERENCE TO RELATED APPLICATIONS

This application is a U.S. National Stage Entry of International Patent Application Serial Number PCT/EP2013/066119, filed Jul. 31, 2013, which claims priority to German patent application no. DE 102012107043.1, filed Aug. 1, 2012.

FIELD

The invention relates to a roller mill and a method for comminuting material to be ground with a roller mill, wherein at least two grinding rollers interact with a grinding plate for comminuting material to be ground.

BACKGROUND

Different concepts are adopted as the drive system of roller mills, for example DE 20 2009 016 825 U1 describes, for example, a roller mill having a grinding plate and a plurality of grinding rollers which roll on the grinding plate, wherein only the grinding plate are driven by means of at least two drives with a motor and gear mechanism. The at least two drives engage here in a common gear rim, with the result that all the drives have to rotate with the same rotational speed. In order to homogenize the load, at least one of the drives is provided with a turbocoupling.

DE 10 2006 050 205 A1 also discloses a roller mill whose grinding plate is driven by an arrangement of more than two drives. Electric motors which are fed via frequency convertors and which are used to regulate the rotational speed and torque are provided for the drives. The frequency convertors are organized according to the master-slave principle in order to ensure that all the drives operate synchronously. However, these frequency convertors result in high costs for the drive trains.

Furthermore, it is known, for example, from DE 10 2008 036 784 A1 to drive the grinding rollers instead of the grinding plate. In order to reduce the costs for the regulating devices, this application proposes that the grinding rollers each have a motor with a rotor winding and at least one regulating device is provided for regulating the motor torque of at least one drive, wherein the regulating device is connected here to the rotor winding of at least one drive in order to influence the rotor current. The influencing of the rotor current can take place, for example, by means of convertors whose power is adjusted, with this method of applying influence, according to the rotational speed deviation between the operating point and the rated point, generally ≤40% of the rated motor power. It is therefore possible for convertors with a substantially lower power to be used, and since the convertor costs are virtually proportional to their power it is possible to achieve a significant cost saving here.

WO 2009/030609 A1 describes a method for comminuting material to be ground with a roller mill in which at least two grinding rollers are provided with assigned drives, wherein a power compensation regulation is carried out for the two drives in that by regulating the grinding pressure of at least one of the grinding rollers the power of the drives are regulated in a predefined ratio with respect to one another.

DE 10 2007 033 256 A1 discloses a roller mill which comprises a main drive and an additional drive for driving the grinding plate, wherein a regulating device regulates the additional drive as a function of torque fluctuations of the main drive and/or fluctuations in the rotational speed of the grinding plate.

BRIEF DESCRIPTION OF THE DRAWINGS

The present disclosure is described in detail below with reference to the attached drawing figure, wherein.

DETAILED DESCRIPTION

Figure 1:
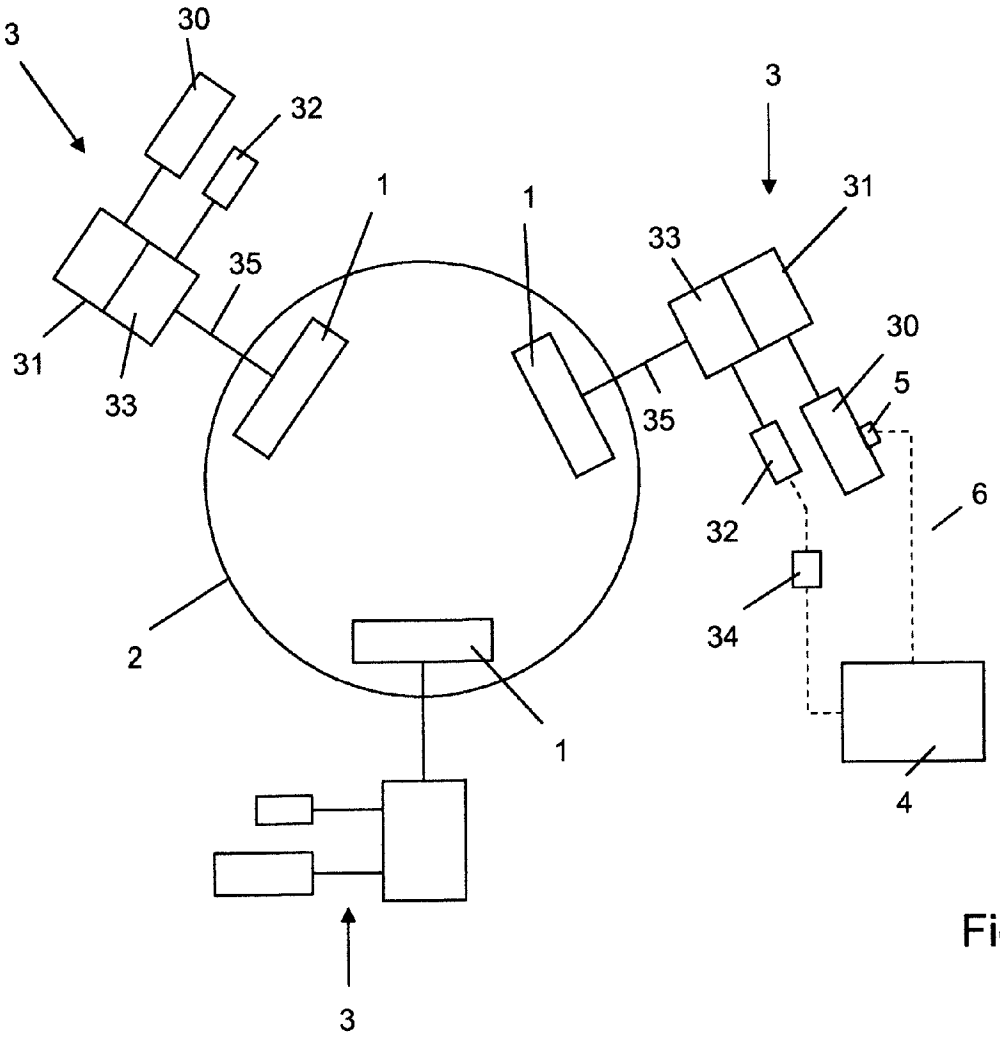
FIG. 1 is a schematic top view of an embodiment of a roller mill having a grinding roller drive, wherein a superimposition gear mechanism that interacts with a regulating drive is integrated in a main gear mechanism, as disclosed herein.

The present invention is then based on the object of specifying a new concept for regulating the drives which permits cost-effective regulation.

According to the invention, this object is achieved by means of the features of claims 1 and 8.

The roller mill according to the invention is composed essentially of at least two grinding rollers which interact with a grinding plate for comminuting material to be ground, wherein the at least two grinding rollers or the grinding plate and at least one grinding roller are each assigned a separate drive train for driving same, wherein each drive train has a main motor and a main gear mechanism. At least one drive train additionally comprises a superimposition gear mechanism with a regulating drive, wherein an open-loop and closed-loop control device which is connected to the at least one regulating drive is provided, said open-loop and closed-loop control device regulating the power of the separate drive trains with respect to one another by means of the at least one regulating drive.

In methods according to the invention for comminuting material to be ground, the material to be ground is comminuted between at least two grinding rollers and a grinding plate, wherein the at least two grinding rollers or the grinding plate and at least one grinding roller are driven by means of separate drive trains which each comprise a main motor and a main gear mechanism. Furthermore, at least one drive train is additionally equipped with a regulating drive which engages in the drive train by means of a superimposition gear mechanism and regulates the power of the individual drives with respect to one another by means of the at least one regulating drive.

The invention is based on the concept that regulation of power does not necessarily require regulation over the entire power of the drive train. The regulating intervention is usually only 5 to 50% of the entire power of the drive train. It is therefore sufficient if the at least one regulating drive contributes this percentage to the overall power. This in turn has the consequence that a correspondingly relatively small regulating drive can also be equipped with a relatively small and therefore correspondingly more cost-effective frequency convertor.

Further refinements of the invention are the subject matter of the dependent claims.

According to one preferred refinement of the invention, the power of the regulating drive is between 5 and 30%, preferably between 7 and 20%, of the total power of the assigned drive train. Furthermore, each regulating drive can be assigned a frequency convertor which can be actuated by the open-loop and closed-loop control device.

According to a further refinement of the invention, at least one measuring device which is connected to the open-loop and closed-loop control device is provided for detecting at least one operating parameter such as the rotational speed or torque of the grinding rollers and/or of the grinding plate. The detected operating parameter then serves to actuate the regulating drive.

The regulating drive can either be integrated into the main gear mechanism or embodied as a preliminary gear mechanism stage. Furthermore, the superimposition gear mechanism can be formed by a planetary gear mechanism with a planetary carrier, ring gear and sun gear, wherein the regulating drive is preferably coupled to the ring gear or to the planetary carrier or the sun gear.

A plurality of exemplary embodiments of the present disclosure are described greater detail below with reference to the attached drawing figures.

FIG. 1 shows a first exemplary embodiment of a roller mill according to the invention having a plurality of grinding rollers 1 which interact with a grinding plate 2 for comminuting material to be ground. Furthermore, each grinding roller 1 is driven by means of a separate drive train 3 which respectively has a main motor 30, a main gear mechanism 31, a superimposition gear mechanism 33 and a regulating drive 32, wherein it is not necessary for the regulating drive 32 and the superimposition gear mechanism 33 to be provided in each drive train. Instead of the three grinding rollers illustrated, it is, of course, also possible to provide fewer, in particular 2 grinding rollers or more grinding rollers, for example 4 grinding rollers.

In addition, an open-loop and closed-loop control device 4 which is connected to the regulating drive 32 is provided, said open-loop and closed-loop control device 4 regulating the power of the drive trains 3 with respect to one another by means of the regulating drives 32. The regulation can be performed here, for example, in such a way that each drive train provides the same power. For reasons of clarity, in FIG. 1 only one drive train 3 is connected to the open-loop and closed-loop control device 4. Of course, the open-loop and closed-loop control device 4 is also connected to the other two drive trains in a corresponding way.

The total power of a drive train is composed of the power levels of the main motor 30 and of the regulating drive 32, wherein the power of the regulating drive is preferably between 5 and 30%, most preferably between 7 and 20%, of the total power of a drive train. Each regulating drive 32 is assigned a frequency convertor 34, which can be actuated by the open-loop and closed-loop control device, for influencing the regulating drive. The regulation takes place as a function of at least one operating parameter such as, for example, the rotational speed of the grinding roller 1 and/or the torque of the main motor 30. For this purpose, a measuring device 5 is provided at a suitable location, said measuring device 5 detecting the desired operating parameter and transmitting it to the open-loop and closed-loop control device 4 via a line 6.

Since a frequency convertor for regulating an assigned drive has to be adapted to the power of the drive, the frequency convertor 34 can be matched to the power of the regulating drive 32 which is significantly lower compared to the main motor 30.

In the exemplary embodiment in FIG. 1, the superimposition gear mechanism 33 is integrated in the main gear mechanism 31. The rotational movements of main motor 30 and regulating drive 32 are correspondingly converted there and transmitted to the grinding roller 1 via an output 35.

Figure 5:
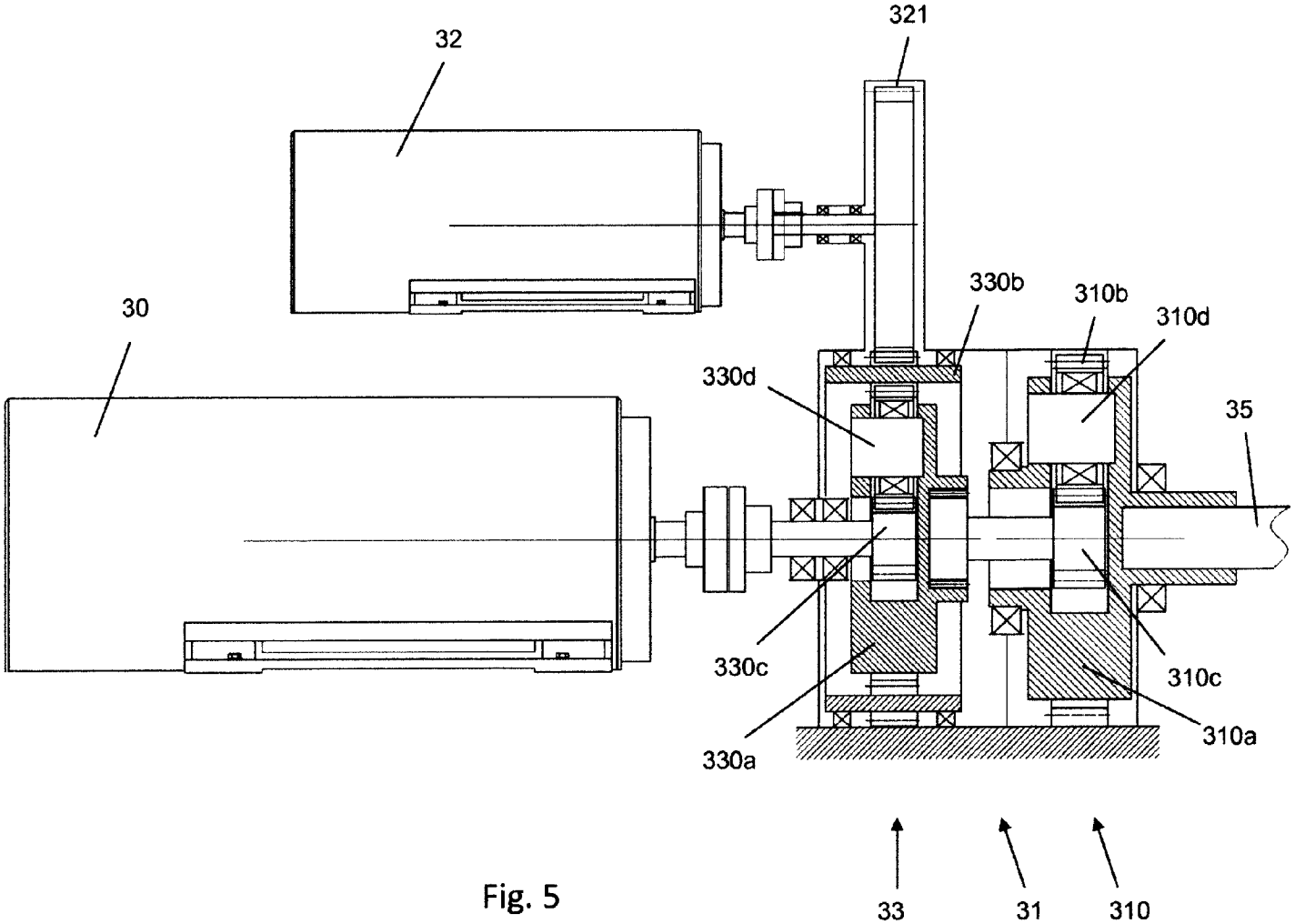
FIG. 5 is a cross-sectional detail view of a drive train of the grinding roller drive of FIGS. 1 and 3, wherein the superimposition gear mechanism is integrated in the main gear mechanism.

FIG. 5 shows an enlarged illustration of the drive train 3 for the grinding roller drive. It is apparent herefrom that the main gear mechanism 31 in the illustrated exemplary embodiment is composed of two planetary stages, specifically from the superimposition gear mechanism 33 formed as a planetary gear mechanism stage, and a planetary main stage 310. The superimposition gear mechanism 33 comprises, in a generally known fashion, a planetary carrier 330*a*, a ring gear 330*b*, a sun gear 330*c* and planetary gears 330*d*. The regulating drive 32 is coupled to the ring gear 330*b* via an output gear wheel 321. The sun gear 330*c* is in drive contact with the main motor 30.

The planetary main stage 310 is composed in a similar way from a planetary carrier 310*a*, a ring gear 310*b*, a sun gear 310*c* and planetary gears 310*d*. In order to couple the two planetary stages, the planetary carrier 330*a* are connected to the sun gear 310*c*. The output 35 is coupled to the planetary carrier 310*a* and drives the grinding roller 1.

Figure 2:
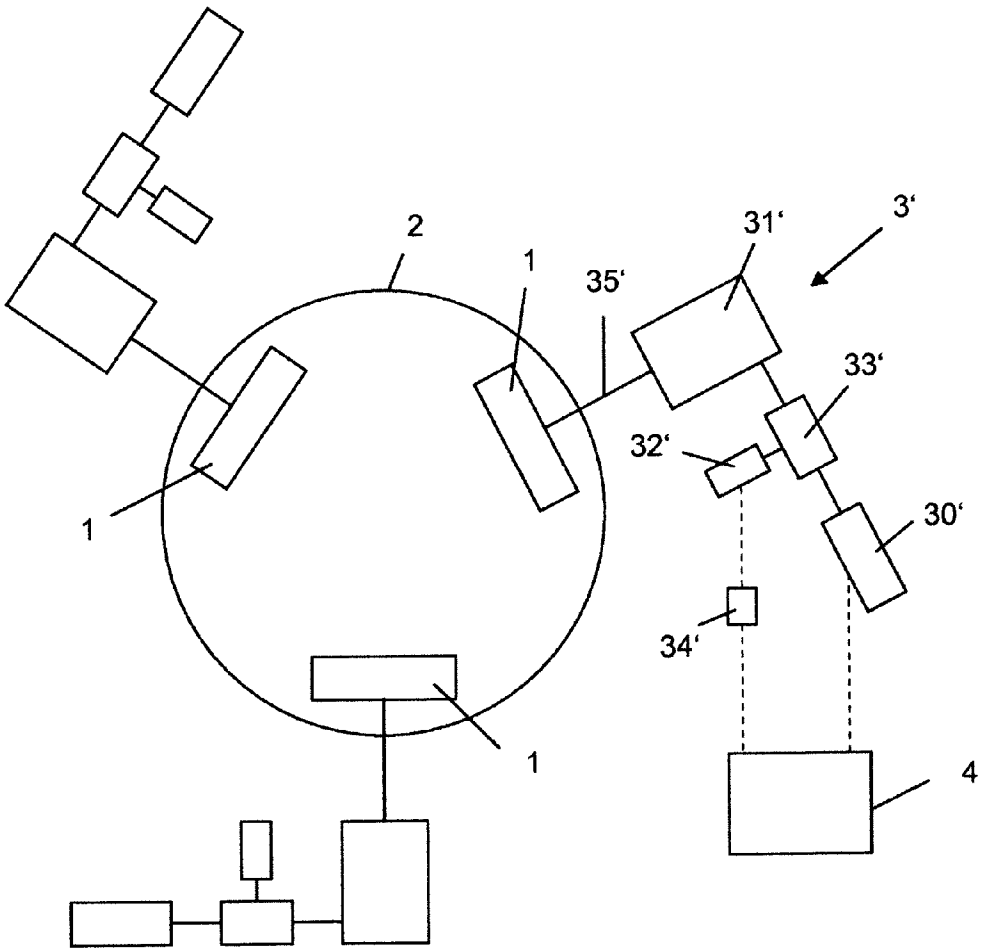
FIG. 2 is a schematic top view of an embodiment of a roller mill having a grinding roller drive, wherein the superimposition gear mechanism that interacts with the regulating drive is embodied as a preliminary gear mechanism stage, as disclosed herein.

Instead of integrating the superimposition gear mechanism 33 into the main gear mechanism 31, the superimposition gear mechanism can also be embodied as a preliminary gear mechanism stage. A corresponding exemplary embodiment is illustrated in FIG. 2. In the drive train 3', the superimposition gear mechanism 33' which is embodied as a preliminary gear mechanism stage is provided between the main motor 30' and the main gear mechanism 31' and is connected to the regulating drive 32', which is in turn actuated as a function of an operating parameter by means of the open-loop and closed-loop control device 4 and a frequency convertor 34'.

Figure 6:
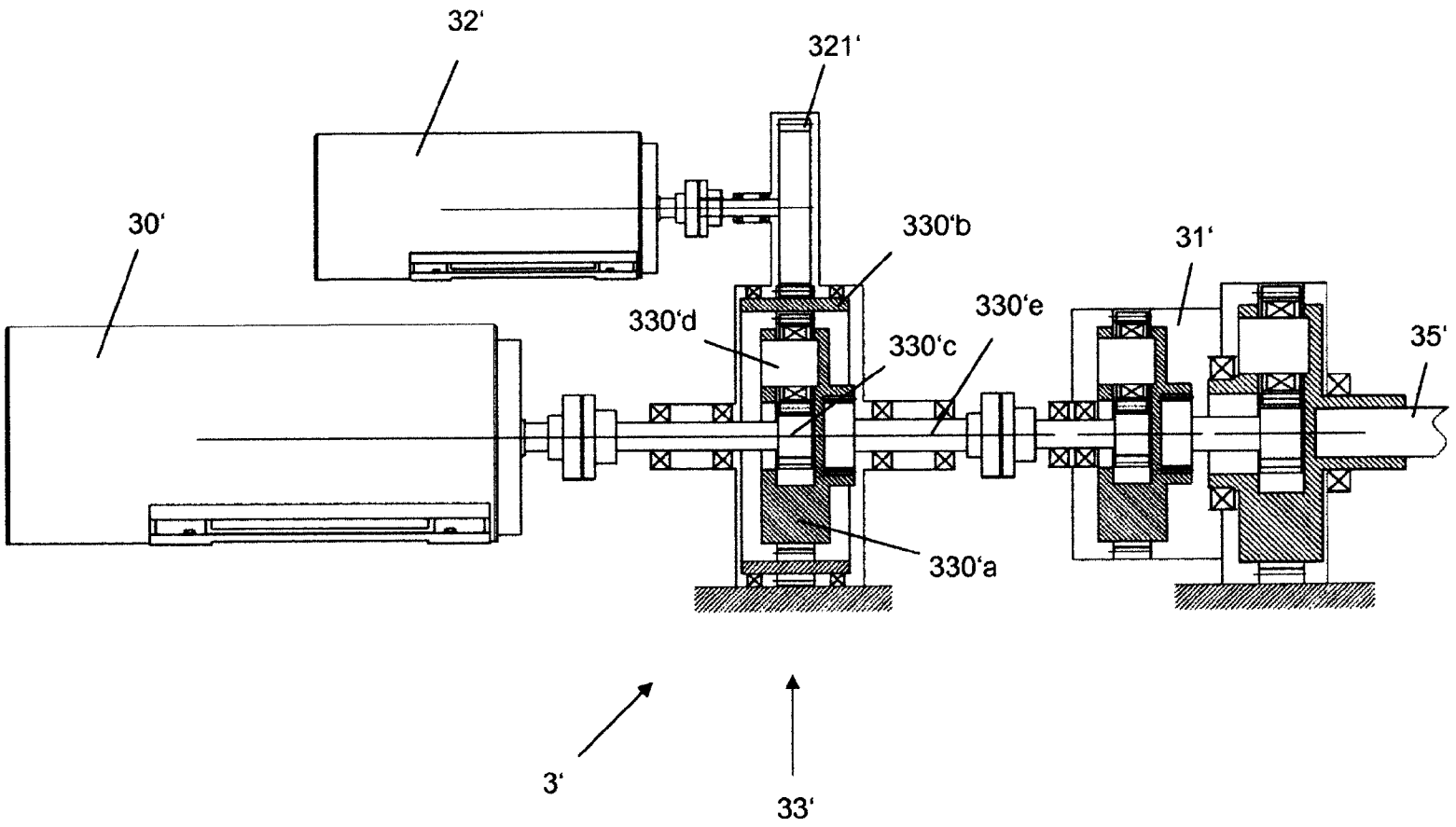
FIG. 6 is a cross-sectional detail view of a drive train of the grinding roller of FIGS. 2 and 4, wherein the superimposition gear mechanism is a preliminary gear mechanism stage.

The drive train 3' is illustrated in FIG. 6 in more detail. The superimposition gear mechanism 33' is in turn embodied as a planetary gear mechanism stage and comprises a planetary carrier 330'*a*, a ring gear 330'*b*, a sun gear 330'*c* and planetary gears 330'*d*. The regulating drive 32' is also coupled here to the ring gear 330'*b* via a drive gear wheel 321'. The sun gear 330'*c* is driven by means of the output shaft of the main motor 30'. The output train 330'*e* of the superimposition gear mechanism 33' is coupled to the main gear mechanism 31', where a further reduction of the rotational speed occurs. The main gear mechanism 31' is embodied here as a double planetary stage, but can also be formed as a spur gear stage or bevel gear stage or as a combination of various gear mechanism stages. The output 35' drives the grinding roller 1 directly.

Figure 3:
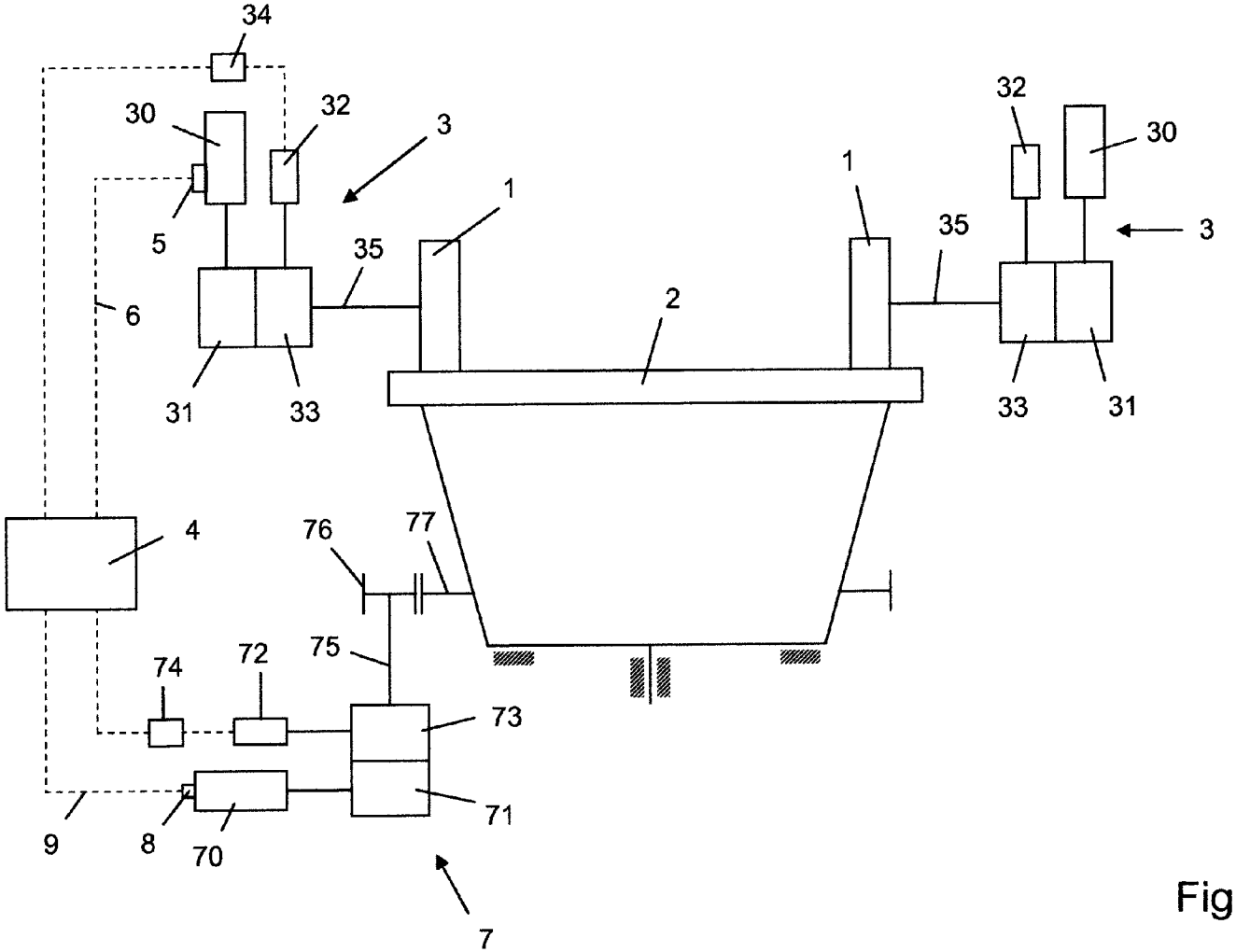
FIG. 3 is a schematic side view of a roller mill having a grinding roller drive and a grinding plate, wherein a superimposition gear mechanism that interacts with a regulating drive is integrated in a main gear mechanism.

While only the grinding rollers are driven in the two first exemplary embodiments according to FIGS. 1 and 2, in the exemplary embodiment according to the FIG. 3 a grinding plate drive is also provided as well as the grinding roller drive. The grinding roller drive the occurs in turn via an individual drive 3, such as has been described in more detail with reference to FIGS. 1 and 5.

The grinding plate drive provides a drive train 7, which has a main motor 70, a main gear mechanism 71, a superimposition gear mechanism 73 and a regulating drive 72. The regulating drive 72 is also connected to the open-loop and closed-loop control device 4 which regulates the power of the drive trains 3 and 7 with respect to one another by means of the regulating drives 32 and 72 with assigned frequency convertors 34, 74. For reasons of clarity, only one drive train 3 is connected to the open-loop and closed-loop control device 4 in FIG. 3. Of course, the open-loop and closed-loop control device 4 can also be connected to the further grinding roller drive trains in a corresponding way.

The regulation occurs in turn as a function of at least one operating parameter, such as for example the rotational speed of the grinding roller 1, the rotational speed of the grinding plate 2 or the torque of the main motor 30. For this purpose, measuring devices 5, 8 which detect the desired operating parameter and transmit it to the open-loop and closed-loop control device 4 via lines 6, 9 are provided at a suitable location.

In the exemplary embodiment in FIG. 3 the superimposition gear mechanism 73 of the grinding plate drive is integrated in the main gear mechanism 71. The rotational movements of the main motor 70 and of the regulating drive 72 are correspondingly converted there and transmitted via an output 75 to a pinion 76 and a gear rim 77 of the grinding plate 2.

Figure 7:
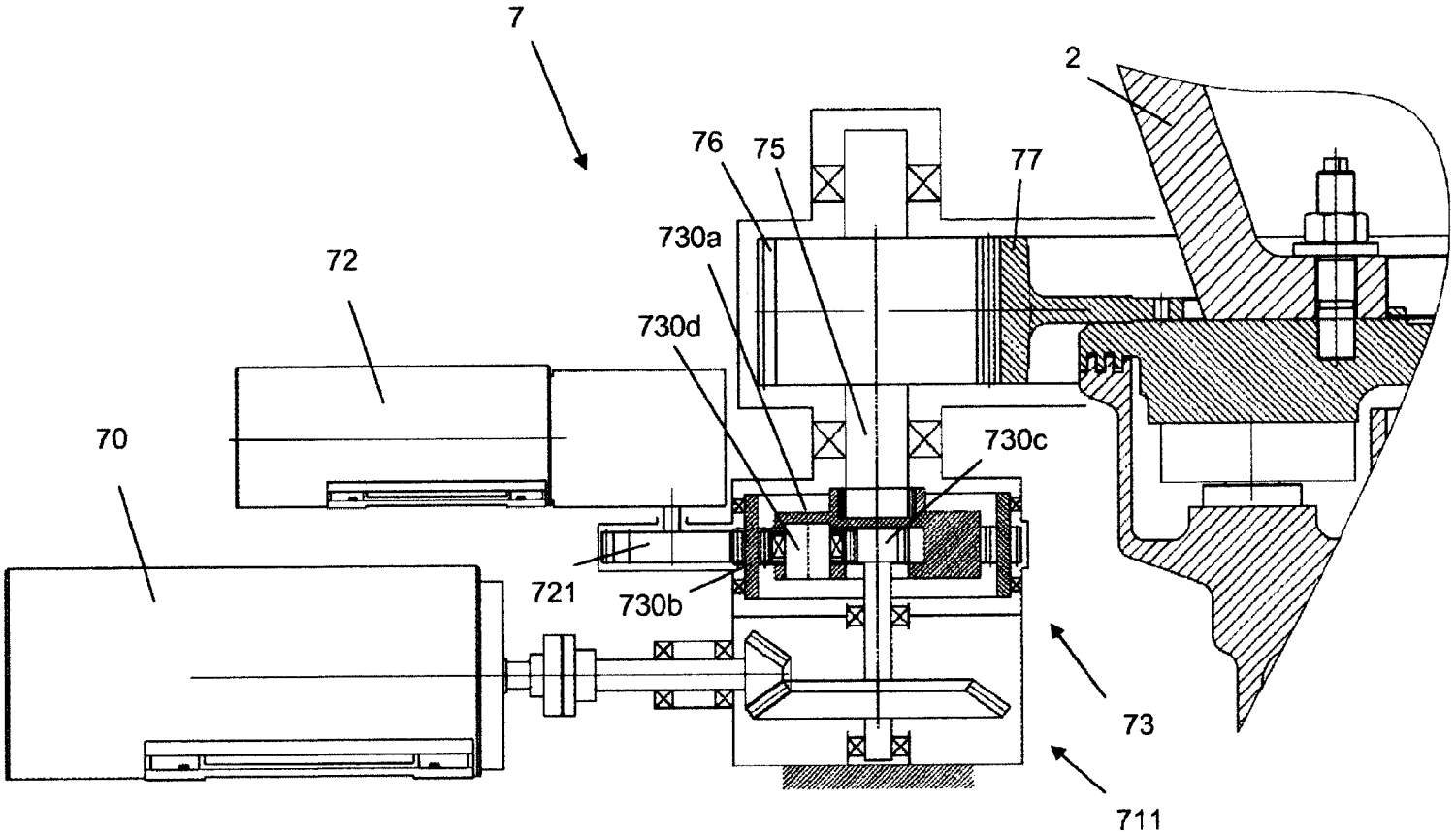
FIG. 7 is cross-sectional detail view of a drive train of the grinding plate drive of FIG. 3, wherein the superimposition gear mechanism is integrated in the main gear mechanism.

The drive train 7 is illustrated in FIG. 7 in more detail. The main gear mechanism is composed here of a bevel gear mechanism stage 711 in combination with the superimposition gear mechanism 73 embodied as a planetary gear mechanism stage. The superimposition gear mechanism 73 comprises a planetary carrier 730*a*, a ring gear 730*b*, a sun gear 730*c* and planetary gears 730*d*. The regulating drive 72 is also coupled to the ring gear 730*b* here via an output gear wheel 721. The sun gear 730*c* is in drive contact with the main motor 70 via the bevel gear mechanism. The output 75 of the superimposition gear mechanism 73 is coupled to the grinding plate 2 via the pinion 76 and the gear rim 77 in order to transmit the rotational movement.

Figure 4:
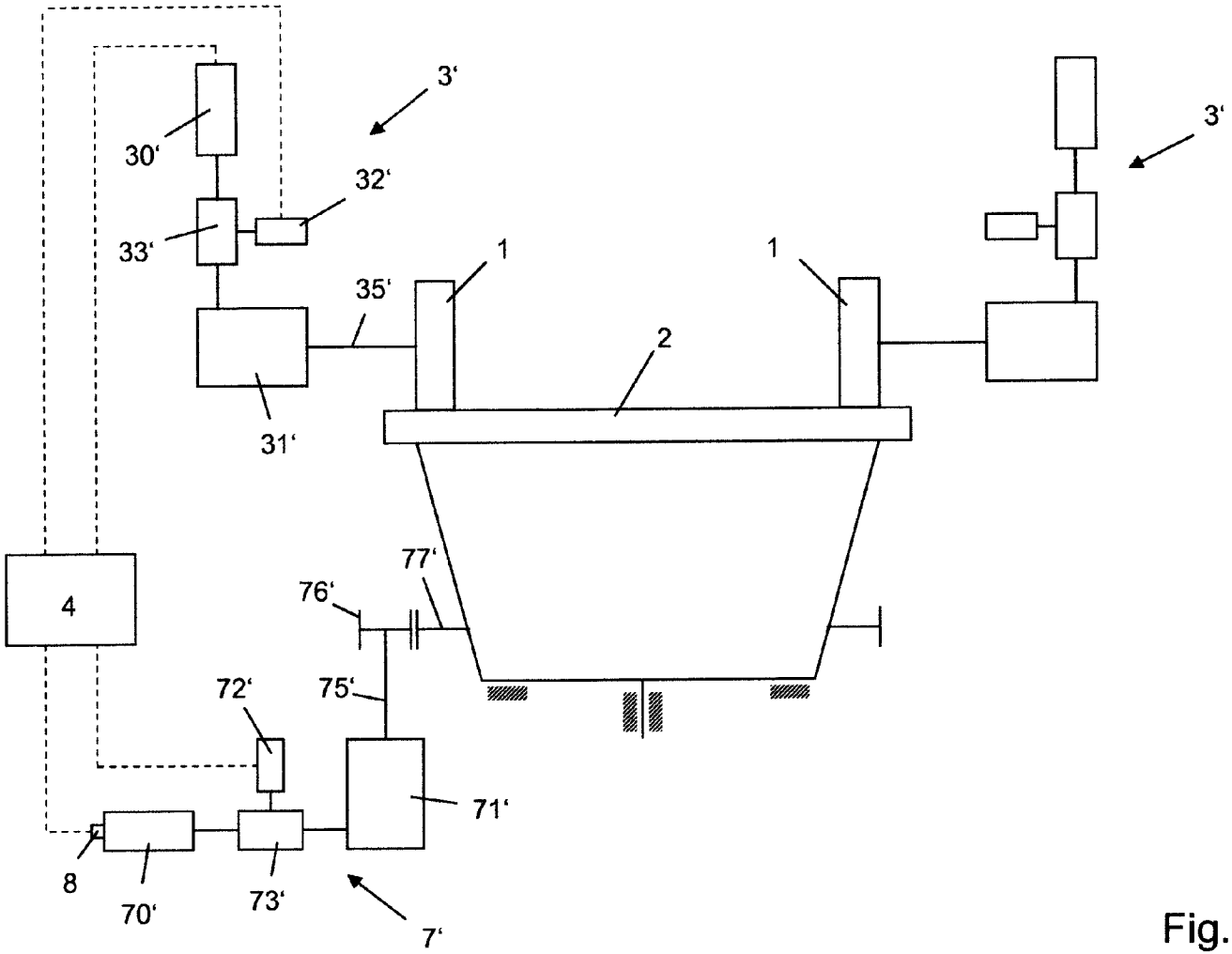
FIG. 4 is a schematic side view of a roller mill having a grinding roller drive and a grinding plate drive, wherein a superimposition gear mechanism that interacts with a regulating drive is embodied as a preliminary gear mechanism stage.

In the exemplary embodiment according to FIG. 4, a grinding roller drive is again combined with a grinding plate drive, wherein at least one grinding roller 1 or preferably a plurality of or all of the grinding rollers 1 are driven via separate drive trains 3', as is explained in more detail on the basis of FIGS. 2 and 6.

The grinding plate drive comprises a drive train 7', in which the superimposition gear mechanism 73' is embodied in turn as a preliminary gear mechanism stage and is provided between the main motor 70' and the main gear mechanism 71' and is connected to the regulating drive 72', which is in turn actuated as a function of at least one operating parameter by means of the open-loop and closed-loop control device 4.

Figure 8:
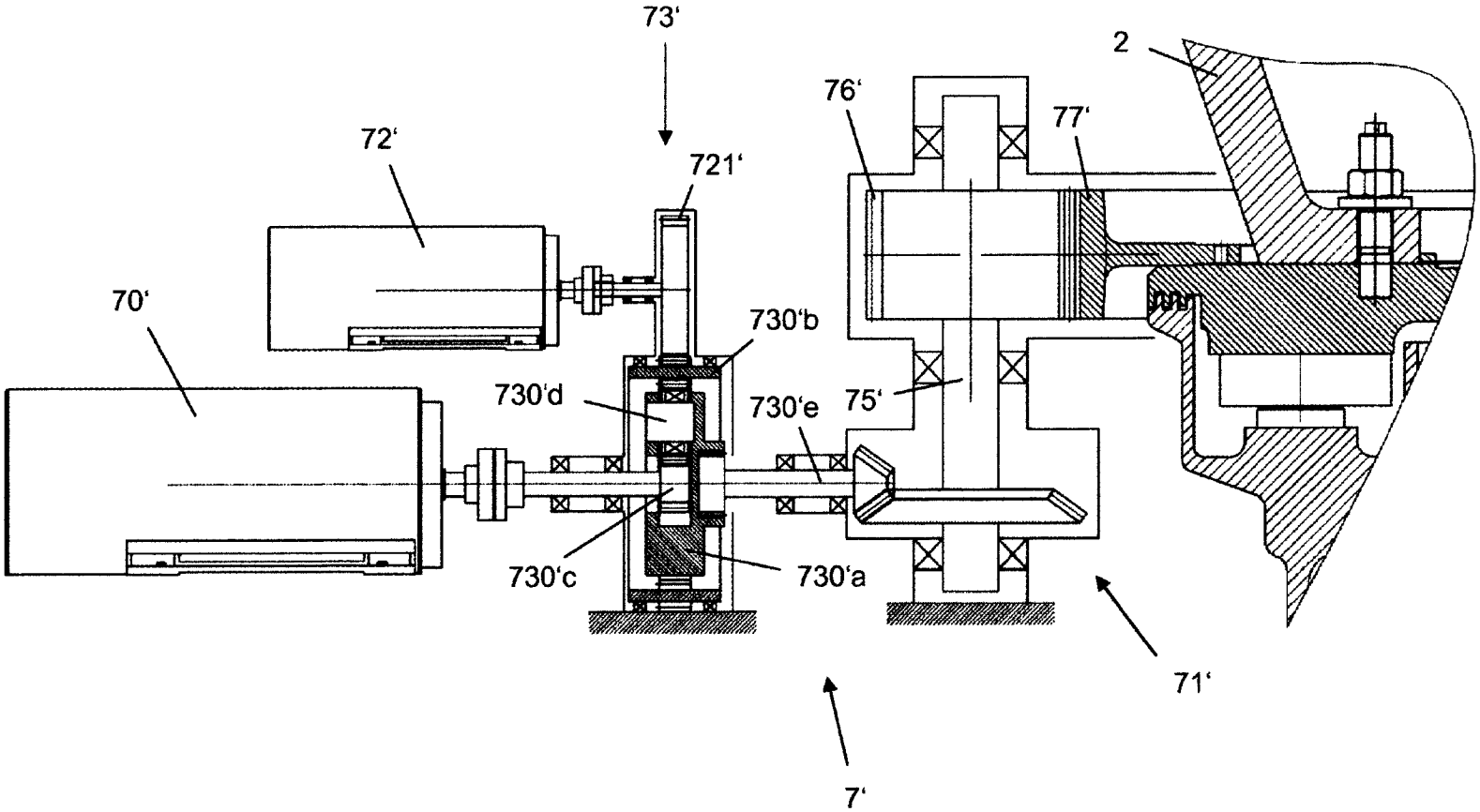
FIG. 8 is cross-sectional detail view of a drive train of the grinding plate drive of FIG. 4, wherein the superimposition gear mechanism is a preliminary gear mechanism stage.

The drive train 7' is illustrated in FIG. 8 in more detail. The superimposition gear mechanism 73' is embodied in turn as a planetary gear mechanism stage and comprises a planetary carrier 730'*a*, a ring gear 730'*b*, a sun gear 730'*c* and planetary gears 730'*d*. The regulating drive 72' is also coupled to the ring gear 730'*b* via an output gear wheel 721' here. The sun gear 730'*c* is in turn in drive contact with the main motor 70'. The output train 730'*e* of the superimposition gear mechanism 73' is coupled to the main gear mechanism 71' which is embodied as a bevel gear mechanism stage, where a further reduction in the rotational speed takes place. The output 75' drives the grinding plate 2 via the pinion 76' and the gear rim 77'.

The individual grinding rollers 1 are coupled to one another, on the one hand, via the grinding plate 2 and the material to be ground or bed material to be ground located on the latter, and said grinding rollers 1 can, on the other hand, have very different power take-up levels, owing, for example, to different rolling diameters on the grinding plate (position of the force application point), different effective diameters of the individual grinding rollers (for example owing to wear), and a different drawing behavior of the material to be ground in combination with the grinding plate and grinding roller.

Even small deviations in rotational speed between individual grinding rollers bring about relatively high fluctuations in power at the drives. This can lead to a situation in which the grinding rollers are continuously accelerated or decelerated, i.e. the individually driven grinding rollers operate against one another, which gives rise to a significantly increased force requirement or energy requirement during the communication operation. By means of suitable measurement of operating parameters such as rotational speed of grinding roller and/or grinding plate or of the power take-up of the main motors of the associated drive trains it is possible to determine and evaluate power fluctuations between the drive trains which are present. While hitherto the regulation of the power of the individual drive trains with respect to one another was carried out by means of frequency convertors of the main motors, with the invention described above the power regulation can be carried out by means of the regulating drives which have substantially lower power. Usually efforts will be made to operate all the drive trains of the grinding roller drives with the same power. If a grinding plate drive is additionally provided, it will be operated with a predefined ratio with respect to the total power of all the drive trains. This ratio can be, for example, 20 to 30%.

The invention claimed is:

1. A roller mill comprising:

a grinding plate;

at least two grinding rollers configured to interact with said grinding plate to comminute material to be ground;

at least two separate drive trains each having a main motor and a main gear mechanism, and each configured to drive the at least two grinding rollers or the grinding plate and one or more of the at least two grinding rollers, wherein at least a first drive train of said at least two separate drive trains further includes a superimposition gear mechanism, at least one regulating drive in communication with said superimposition gear mechanism, wherein the superimposition gear mechanism converts rotational movements of the main motor and the at least one regulating drive, an open-loop and closed-loop control device in communication with said at least one regulating drive, wherein the open-loop and closed-loop control device is configured by way of the at least one regulating drive to regulate power of said separate drive trains with respect to one another.

2. The roller mill of claim 1, wherein the power of said at least one regulating drive is between 5% and 30% of a total power of each drive train.

3. The roller mill of claim 1, wherein at least said first drive train further includes a separate frequency converter in communication with said at least one regulating drive, with each frequency converter configured to be actuated by said open-loop and closed-loop control device.

4. The roller mill of claim 1, wherein at least said first drive train further includes at least one measuring device in communication with said open-loop and closed-loop control device and configured to detect at least one operating parameter of said roller mill.

5. The roller mill of claim 1, wherein said superimposition gear mechanism of the first drive train is one of integrated into said main gear mechanism of the first drive train or is a preliminary gear mechanism stage of the first drive train.

6. The roller mill of claim 1, wherein said superimposition gear mechanism is a planetary gear mechanism having a planetary carrier, ring gear and sun gear, and wherein said at least one regulating drive is coupled to one of said planetary carrier, ring gear, or sun gear.

7. The roller mill of claim 1, wherein said superimposition gear mechanism has an adjustable transmission ratio.

8. A method of comminuting material to be ground, comprising:

providing a roller mill as in claim 1;

driving one or more of said grinding plate and each of said at least two grinding rollers by the at least two separate drive trains;

regulating a power of the at least two separate drive trains with respect to one another by means of the at least one regulating drive;

comminuting the material to be ground between the at least two grinding rollers and the grinding plate.

9. The method of claim 8, wherein said at least one regulating drive contributes between 5% and 30% of a total power of a drive train.

10. The method of claim 8, further comprising:

measuring at least one operating parameter of the roller mill;

actuating the at least one regulating drive based on the at least one measured operating parameter.

* * * * *